US008313161B2

(12) United States Patent
Tabata et al.

(10) Patent No.: US 8,313,161 B2
(45) Date of Patent: Nov. 20, 2012

(54) LIQUID EJECTING APPARATUS AND LIQUID EJECTING PRINTING APPARATUS

(75) Inventors: Kunio Tabata, Shiojiri (JP); Atsushi Oshima, Shiojiri (JP); Noritaka Ide, Shiojiri (JP); Shinichi Miyazaki, Suwa (JP); Hiroyuki Yoshino, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 209 days.

(21) Appl. No.: 12/914,628

(22) Filed: Oct. 28, 2010

(65) Prior Publication Data

US 2011/0102486 A1 May 5, 2011

(30) Foreign Application Priority Data

Oct. 29, 2009 (JP) ..... 2009-249187

(51) Int. Cl.
*B41J 29/38* (2006.01)

(52) U.S. Cl. ..... 347/11; 347/10

(58) Field of Classification Search ..... 347/5, 9, 347/10, 11, 14, 19, 57–59
See application file for complete search history.

(56) References Cited

U.S. PATENT DOCUMENTS 7,244,007 B2 * 7/2007 Ishizaki ..... 347/5
7,463,388 B2 * 12/2008 Tomiyasu et al. ..... 358/3.24
7,798,591 B2 9/2010 Ishizaki
2008/0018687 A1 * 1/2008 Tabata et al. ..... 347/11

FOREIGN PATENT DOCUMENTS

| | | |
|---|---|---|
| JP | 02-060490 | 2/1990 |
| JP | 2000-022458 | 1/2000 |
| JP | 2007-168172 | 7/2007 |
| JP | 2009-153272 | 7/2009 |
| JP | 2009-154478 | 7/2009 |

* cited by examiner

*Primary Examiner* — Juanita D Jackson

(74) *Attorney, Agent, or Firm* — Maschoff Gilmore & Israelsen

(57) ABSTRACT

A liquid ejecting apparatus includes: a Modulator that performs pulse modulation for a drive waveform signal that becomes a reference for a drive signal of an actuator so as to acquire a modulated signal; a digital power amplifier that amplifies the power of the modulated signal so as to acquire a amplified digital signal; a low pass filter that smoothes the amplified digital signal so as to acquire the drive signal; a variable power source circuit that can change a power source voltage of the digital power amplifier; and a power source voltage control unit that controls changes in the power source voltage in units of a driving pulse that configures the drive signal of the actuator and can independently drive the actuator.

10 Claims, 12 Drawing Sheets

FIG.12A

| CHARAC-TERISTIC SYMBOL | CORRECTION VALUE $\alpha$ |
|---|---|
| a | $\alpha_1$ |
| b | $\alpha_2$ |
| c | $\alpha_3$ |
| d | $\alpha_3$ |
| ⋮ | ⋮ |

HEAD UNEVENNESS CORRECTING VALUE

FIG.12B

| TEMPERA-TURE (°C) | CORRECTION VALUE $\beta$ |
|---|---|
| ⋮ | ⋮ |
| 18 | $\beta_{18}$ |
| 20 | $\beta_{20}$ |
| 22 | $\beta_{22}$ |
| 24 | $\beta_{24}$ |
| ⋮ | ⋮ |

TEMPERATURE CORRECTION VALUE

LIQUID EJECTING APPARATUS AND LIQUID EJECTING PRINTING APPARATUS

BACKGROUND

1. Technical Field

The present invention relates to a liquid ejecting apparatus that ejects liquid by applying a drive signal to an actuator and is appropriate for a liquid ejecting printing apparatus that prints predetermined text, images, or the like by ejecting, for example, a fine liquid from the nozzles of a liquid ejecting head so as to form minute particles (dots) on a printing medium.

2. Related Art

In liquid ejecting printing apparatuses, in order to eject liquid from nozzles of a liquid ejecting head, an actuator such as a piezoelectric device is disposed, and a predetermined drive signal must be applied to the actuator. Thus, in order to supply power that is necessary for driving the piezoelectric device, power amplification is performed by a power amplifier circuit. In JP-A-2007-168172, pulse modulation is performed for a drive waveform signal by a Modulator so as to acquire a modulated signal by using a digital power amplifier that has an extremely small power loss and can be miniaturized, compared to an analog power amplifier, the power of the modulated signal is amplified by using the digital power amplifier so as to acquire a amplified digital signal, and the amplified digital signal modulated signal is smoothed by using a low pass filter so as to acquire a drive signal.

As the modulated signal for the digital power amplifier, for example, a pulse-width modulated signal is used. At this time, the output voltage has a value calculated by multiplying the power source voltage of the digital power amplifier by the duty ratio of the pulse-width modulation. In other words, an arbitrary output voltage can be acquired by controlling the duty ratio of the pulse-width modulation by using the power source voltage. However, in consideration of the efficiency as a drive signal output circuit, the power source voltage supplied to the digital power amplifier is preferably low in the range in which the output voltage can be assured. In the liquid ejecting apparatus disclosed in JP-A-2007-168172, there is room for improvement of the power source voltage.

SUMMARY

An advantage of some aspects of the invention is that it provides a liquid ejecting apparatus and a liquid ejecting printing apparatus using a liquid ejecting apparatus capable of improving efficiency by appropriately controlling the power source voltage supplied to the digital power amplifier.

According to an aspect of the invention, there is provided a liquid ejecting apparatus including: a Modulator that performs pulse modulation for a drive waveform signal that becomes a reference for a drive signal of an actuator so as to acquire a modulated signal; a digital power amplifier that amplifies the power of the modulated signal so as to acquire a amplified digital signal; a low pass filter that smoothes the power-amplified so as to acquire the drive signal; a variable power source circuit that can change a power source voltage of the digital power amplifier; and a power source voltage control unit that controls changes in the power source voltage in units of a driving pulse that configures the drive signal of the actuator and can independently drive the actuator.

According to the liquid ejecting apparatus, by controlling the power source voltage supplied to the digital power amplifier to be changed in units of a driving pulse, the digital power amplifier can be driven with an optimal power source voltage in accordance with the voltage amplitude of the driving pulse, and accordingly, the efficiency is improved.

In addition, in the liquid ejecting apparatus, the power source voltage control unit may stop an operation of the digital power amplifier before the change in the power source voltage and operate the digital power amplifier after the change in the power source voltage.

In such a case, change in the voltage of the drive signal can be avoided during a change in the power source voltage.

In addition, in the liquid ejecting apparatus, it may be configured that the digital power amplifier includes a switching device, and the power source voltage control unit stops the operation of the digital power amplifier by turning off the switching device of the digital power amplifier.

In such a case, the switching device of the digital power amplifier can be set to the high-impedance state. Accordingly, the charging/discharging of the actuator that is a capacitive load can be suppressed.

In addition, in the liquid ejecting apparatus, it may be configured that the drive signal is configured by connecting the driving pulses in a time series, and the power source voltage control unit changes the power source voltage in a connection portion of the driving pulse.

In such a case, the change in the voltage of the driving pulse used for driving the actuator can be avoided.

In addition, in the liquid ejecting apparatus, the power source voltage control unit may change the power source voltage to a high voltage portion and a low voltage portion that configure one driving pulse.

In such a case, the power source voltage of the digital power amplifier can be controlled more finely, and the efficiency can be improved.

In addition, in the liquid ejecting apparatus, a threshold value of the high voltage portion and the low voltage portion may be set to an intermediate voltage having a voltage value that does not change.

In such a case, the change in the voltage of the driving pulse used for driving the actuator can be suppressed or prevented.

In addition, in the liquid ejecting apparatus, the power source voltage control unit may change the power source voltage of the digital power amplifier that is supplied by the variable power source circuit when the modulated signal is in the low level.

In such a case, when the modulated signal is in the low level, the output voltage of the digital power amplifier is not influenced by the change in the power source voltage, and accordingly, the change in the voltage of the driving pulse used for driving the actuator can be avoided.

In addition, in the liquid ejecting apparatus, the power source voltage control unit may change the power source voltage of the digital power amplifier in accordance with individual variations of the liquid ejecting apparatus by using the variable power source circuit.

In such a case, the voltage of the driving pulse used for driving the actuator can be controlled with high precision.

In addition, in the liquid ejecting apparatus, the power source voltage control unit may change the power source voltage of the digital power amplifier that is supplied by the variable power source circuit in accordance with temperature.

In such a case, the voltage of the driving pulse used for driving the actuator can be controlled with high precision.

According to another aspect of the invention, there is provided a liquid ejecting printing apparatus including the liquid ejecting apparatus.

BRIEF DESCRIPTION OF THE DRAWINGS

The invention will be described with reference to the accompanying drawings, wherein like numbers reference like elements.

FIGS. 12A and 12B are tables of correction values used in the calculation process shown in FIG. 11.

DESCRIPTION OF EXEMPLARY EMBODIMENTS

Figure 1:
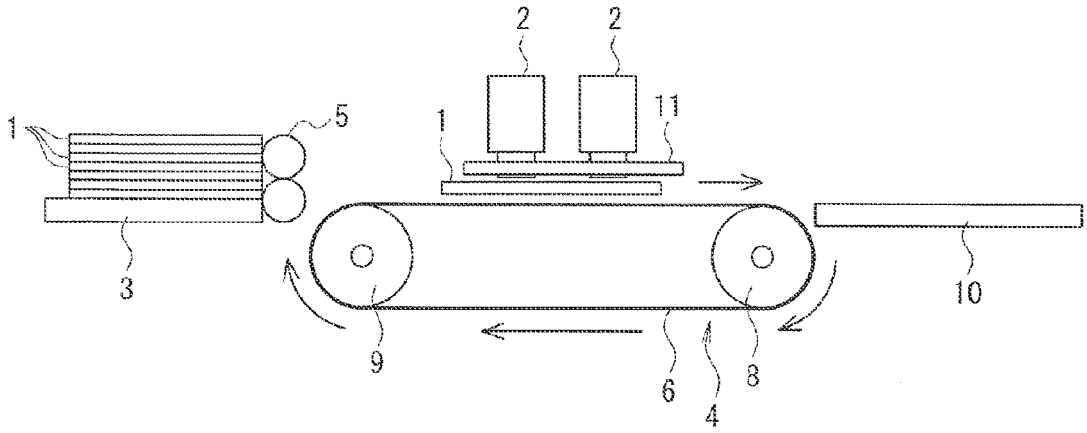
FIG. 1 is a schematic front view showing the configuration of a liquid ejecting printing apparatus using a liquid ejecting apparatus according to a first embodiment of the invention.

Next, a liquid ejecting printing apparatus as a liquid ejecting apparatus according to a first embodiment of the invention will be described. FIG. 1 is a schematic diagram showing the configuration of the liquid ejecting printing apparatus of the first embodiment. In the figure, a printing medium 1 is transported in the direction denoted by an arrow from the left side toward the right side and is printed in a print area in the middle of the transport process. The liquid ejecting printing apparatus is a line head-type printing apparatus (it corresponds to a liquid ejecting printing apparatus).

Figure 2:
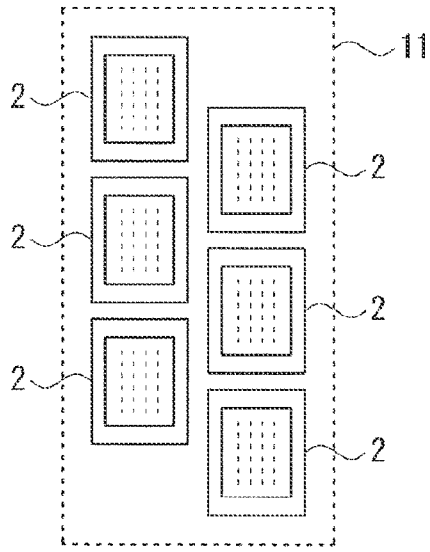
FIG. 2 is a plan view of the vicinity of a liquid ejecting head used in the liquid ejecting printing apparatus shown in FIG. 1.

In FIG. 1, a reference numeral 2 represents a plurality of liquid ejecting heads disposed on the upper side of the transport line of the printing medium 1. The liquid ejecting heads are disposed to be aligned in the direction intersecting the transport direction of the printing medium so as to form two rows in the transport direction of the printing medium and are fixed to a head fixing plate 11. On the lowest surface of each liquid ejecting head 2 (corresponds to a liquid ejecting apparatus), a plurality of nozzles is formed, and this surface is referred to as the nozzle surface. The nozzles, as shown in FIG. 2, are disposed in the shape of a row in the direction intersecting the transport direction of the printing medium for each color of liquid to be ejected. Thus, the row is referred to as a nozzle row, and the row direction is referred to as the direction of the nozzle row. A line head is formed to have a length corresponding to the entire width in the direction intersecting the transport direction of the printing medium 1 by the nozzle rows of all the liquid ejecting heads disposed in the direction intersecting the transport direction of the printing medium 1. When the printing medium 1 passes under the nozzle surface of the liquid ejecting heads 2, liquid is ejected from a plurality of nozzles formed on the nozzle surface to the printing medium 1, whereby a printing process is performed.

To the liquid ejecting head 2, liquid such as ink of four colors, for example, including yellow (Y), magenta (M), cyan (C), and black (K) is supplied from liquid tanks not shown in the figure through liquid supply tubes. Then, by simultaneously ejecting liquid in the necessary volume to the required locations from the nozzles formed in the liquid ejecting head 2, minute dots are formed on the printing medium 1. By performing such an operation for each color, a single pass printing process can be performed by allowing the printing medium 1, which is transported by a transport unit 4, to pass through once.

As a method of ejecting liquid from the nozzle of the liquid ejecting head 2, there are an electrostatic type, a piezo type, a film-boiling liquid ejecting type, and the like. In the first embodiment, the piezo type is used. In the piezo type, when a drive signal is applied to a piezoelectric device as an actuator, a vibration plate inside the cavity is displaced so as to cause a pressure change inside the cavity, and liquid is ejected from the nozzle in accordance with the pressure change. Then, by adjusting the crest value or the slope of the increase/decrease in the voltage of the drive signal, the amount of ejection of the liquid can be adjusted. In addition, an embodiment of the invention can be similarly applied to a liquid ejecting method other than the piezo type.

Below the liquid ejecting heads 2, the transport unit 4 that is used for transporting a printing medium 1 in the transport direction is disposed. The transport unit 4 is configured by winding a transport belt 6 around a driving roller and a driven roller 9. To the driving roller 8, an electrically-driven motor, which is not shown in the figure, is connected. In addition, on the inner side of the transport belt 6, an adsorption device, which is not shown in the figure, used for adsorbing the printing medium 1 to the surface of the transport belt 6 is disposed. As this adsorption device, an air suction device that adsorbs a printing medium 1 to the transport belt 6, for example, depending on negative pressure, an electrostatic adsorption device that adsorbs a printing medium 1 to the transport belt 6 depending on an electrostatic force, or the like is used. Accordingly, when only one printing medium 1 is supplied to the transport belt 6 from a sheet feed unit 3 by a sheet feed roller 5, and the driving roller 8 is driven to rotate by the electrically-driven motor, the transport belt 6 rotates in the transport direction of the printing medium, and the printing medium 1 is transported while being adsorbed to the transport belt 6 by the adsorption device. In the middle of transportation of the printing medium 1, liquid is ejected from the liquid ejecting head 2, whereby the printing process is performed. The printing medium 1 for which the printing process has been completed is discharged to a sheet discharge unit 10 located on the downstream side in the transport direction. In addition, to the transport belt 6, a printing reference signal output device that is, for example, configured by a linear encoder and the like is attached. In consideration of the synchronized movement of the transport belt 6 and the printing medium 1 that is transported while being adsorbed to the transport belt 6, the printing reference signal output device, after the printing medium 1 passes through a predetermined position in the transport path, outputs a pulse signal corresponding to the printing resolution required in accordance with the movement of the transport belt 6. By outputting a drive signal to the actuator from a driving circuit, to be described later, in accordance with the pulse signal, a liquid of a predetermined color is ejected to a predetermined position located on the printing medium 1, and a predetermined image is rendered on the printing medium 1 by the dots.

Figure 3:
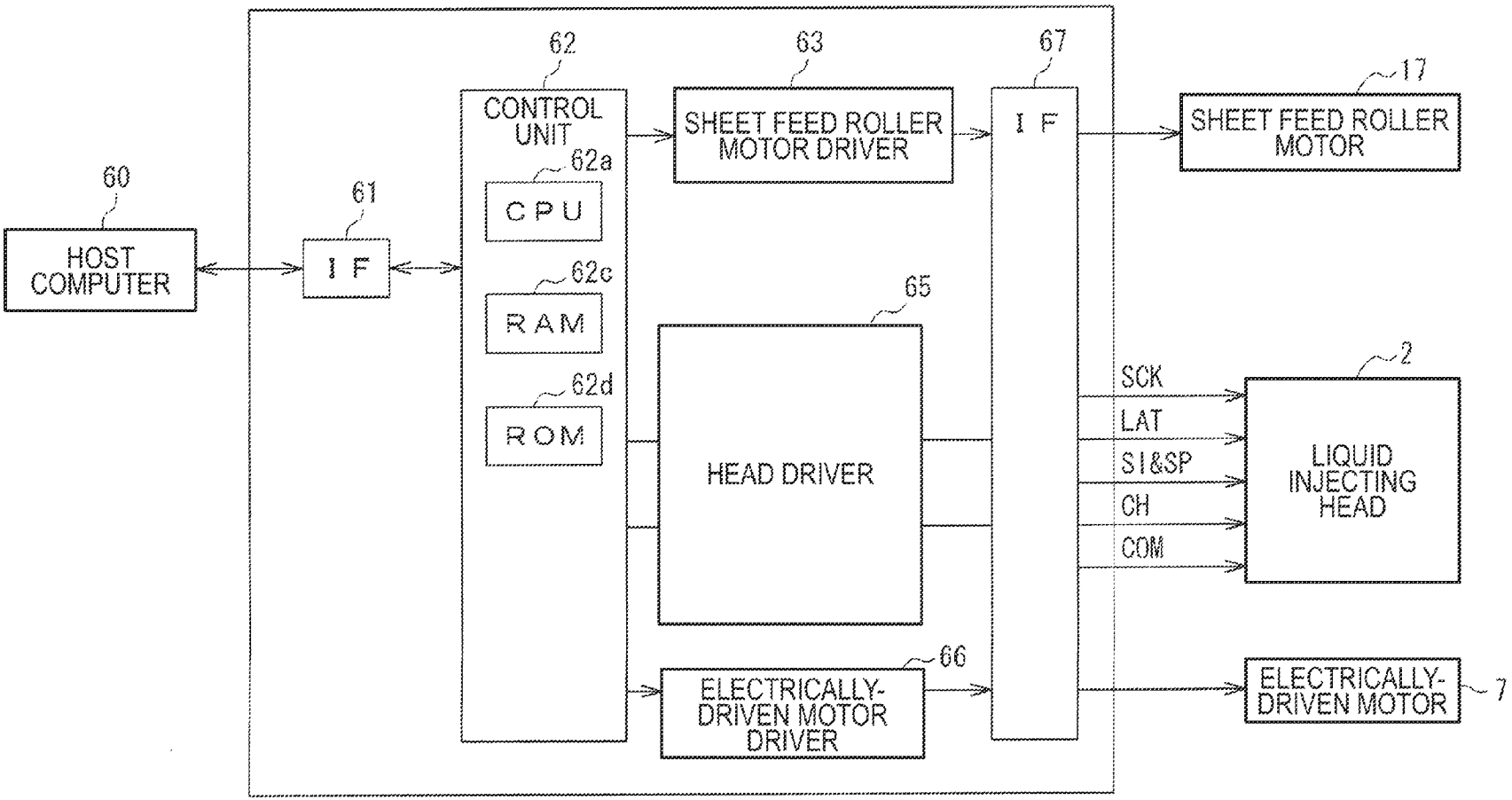
FIG. 3 is a block diagram of a control device of the liquid ejecting printing apparatus shown in FIG. 1.

Inside the liquid ejecting printing apparatus using the liquid ejecting apparatus of the first embodiment, a control device that is used for controlling the liquid ejecting printing apparatus is disposed. This control device, as shown in FIG. 3, includes: an input interface 61 that is used for reading print data input from a host computer 60; a control unit 62 that is configured by a microcomputer that performs a calculation process such as a printing process based on the print data input from the input interface 61; a sheet feed roller motor driver 63 that controls driving of a sheet feed roller motor 17 connected to the sheet feed roller 5; a head driver 65 that controls the driving of the liquid ejecting heads 2; an electrically-driven motor driver 66 that controls the driving of the electrically-driven motor 7 that is connected to the driving roller 8; and an interface 67 that connects the sheet feed roller motor driver 63, the head driver 65, and the electrically-driven motor driver 66 and the sheet feed roller motor 17, the liquid ejecting heads 2, and the electrically-driven motor 7 to each other.

The control unit 62 includes: a CPU (Central Processing Unit) 62*a* that performs various processes such as a printing process; a RAM (Random Access Memory) 62*c* that temporarily stores the print data input through the input interface 61 or various types of data generated when a printing process is performed for the printing data or temporarily expands a program for the printing process or the like; and a ROM (Read Only Memory) 62*d* that is formed from a non-volatile semiconductor memory storing a control program executed by the CPU 62*a* or the like. When the control unit 62 receives the print data (image data) from the host computer 60 through the input interface 61, the CPU 62*a* calculates nozzle selection data (driving pulse selecting data) that is used for determining the nozzle from which liquid is ejected or the amount of liquid to be ejected by performing a predetermined process for the print data and outputs drive signals and control signals to the sheet feed roller motor driver 63, the head driver 65, and the electrically-driven motor driver 66 based on the print data, the driving pulse selecting data, and input data that is from various sensors. The sheet feed roller motor 17, the electrically-driven motor 7, the actuator 22 located inside the liquid ejecting head 2, and the like are operated in accordance with the drive signals and the control signals, and accordingly, a feed process, a transport process, and a sheet discharge process of the printing medium 1 and a printing process for the printing medium 1 are performed. In addition, the constituent elements inside the control unit 62 are electrically connected to each other through a bus not shown in the figure.

Figure 4:
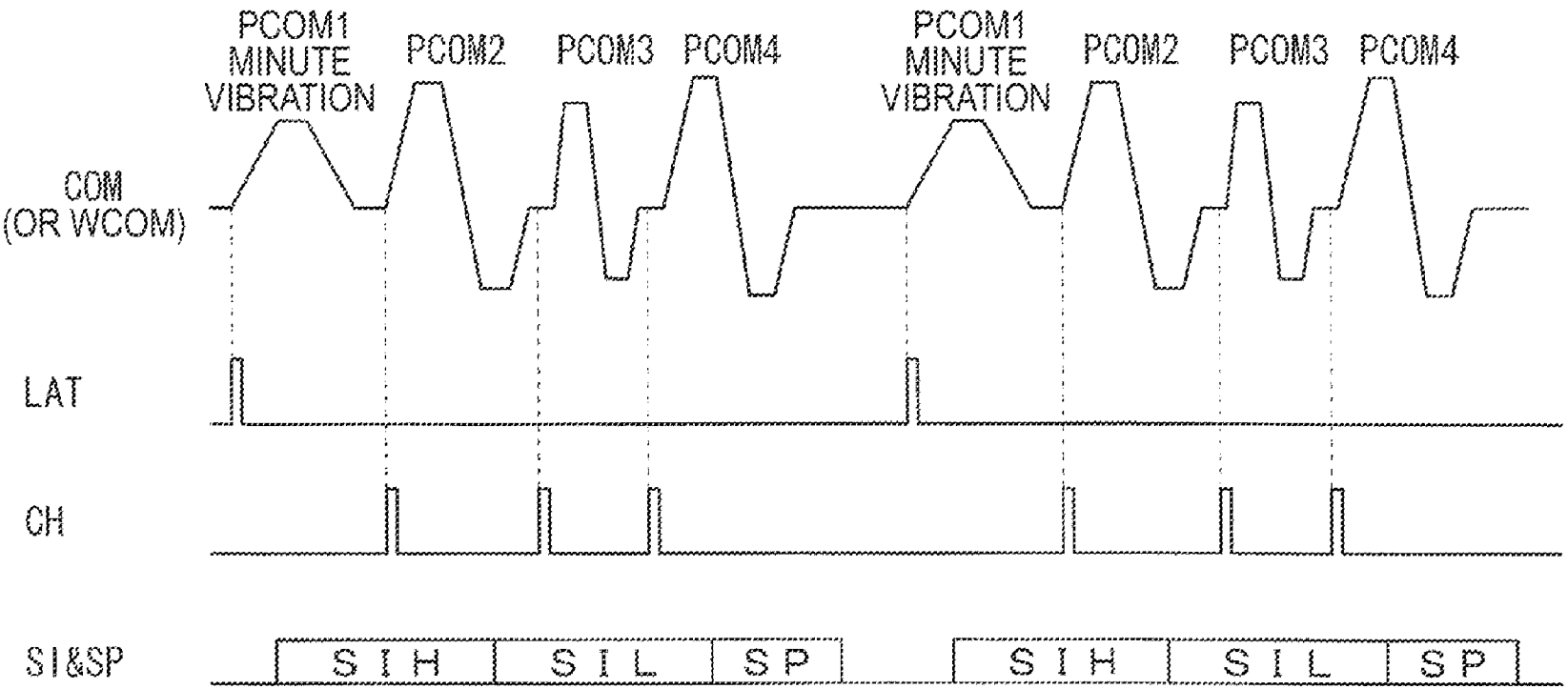
FIG. 4 is a schematic diagram illustrating a drive signal used for driving an actuator disposed inside each liquid ejecting head.

FIG. 4 represents an example of a drive signal COM that is supplied from the control device of the liquid ejecting printing apparatus using the liquid ejecting apparatus of the first embodiment to the liquid ejecting head 2 and is used for driving the actuator 22 that is formed from a piezoelectric device. In the first embodiment, the drive signal is a signal having a voltage that changes with an intermediate voltage used as its center. This drive signal COM is acquired by connecting driving pulses PCOM as unit drive signals each used for driving the actuator 22 so as to eject liquid in a time series. The rising edge portion of the driving pulse PCOM corresponds to a step in which the liquid is drawn in by increasing the volume of the cavity (pressure chamber) communicating with the nozzle (if considering the ejecting surface of the liquid, this may be described as drawing in the meniscus). In addition, the falling edge portion of the driving pulse PCOM corresponds to a step in which the liquid is pressed out by decreasing the volume of the cavity (if considering ejection surface of the liquid, this may be described as pushing out the meniscus), and as the result of the pressing the liquid out, the liquid is ejected from the nozzle.

By variously changing the slope of the increase/decrease in the voltage or the crest value of the driving pulse PCOM that is formed from a voltage trapezoidal wave, the amount drawn in or the inflow speed of the liquid or the amount of compressed output or the compressed output speed of the liquid can be changed. Accordingly, the ejection amount of the liquid can be changed so as to acquire dots having different sizes. Thus, even when a plurality of the driving pulses PCOM is connected in a time series, dots having various sizes can be acquired by ejecting the liquid by selecting a single driving pulse PCOM from among the plurality of the driving pulses and supplying the selected driving pulse to the actuator 22 or ejecting the liquid a plurality of number of times by selecting a plurality of the driving pulses PCOM and supplying the selected driving pulses to the actuator 22. In other words, when a plurality of liquids lands on the same position during a period in which the liquids are not dried, the same result as that of substantially ejecting a large amount of the liquid is acquired, whereby the size of the dot can be increased. By combining such technologies, multiple gray scales can be implemented. The driving pulse PCOM1 shown on the left end in FIG. 4 is not used for ejecting liquid. The driving pulse PCOM1 is referred to as a minute vibration and is used for suppressing or preventing an increase in the viscosity of the nozzle.

To the liquid ejecting head 2, other than the drive signal COM, as control signals transmitted from the control device shown in FIG. 3, a driving pulse selecting data SI&SP that is used for selecting a nozzle for ejection based on the print data and determining the connection timing of the actuator 22 such as a piezoelectric device to the drive signal COM, a latch signal LAT and a channel signal CH that are used for connecting the drive signal COM to the actuator 22 of the liquid ejecting head 2 based on the driving pulse selecting data SI&SP after the nozzle selecting data is input to all the nozzles, and a clock signal SCK that is used for transmitting the driving pulse selecting data SI&SP to the liquid ejecting head 2 as a serial signal are input. Hereinafter, a minimal unit of a drive signal that is used for driving the actuator 22 is described as a driving pulse PCOM, and the entire signal in which the driving pulses PCOM are connected in a time series is described as a drive signal COM. In other words, a series of drive signals COM start to be output in accordance with a latch signal LAT, and a driving pulse PCOM is output for each channel signal CH. In addition, of the driving pulse selecting data SI&SP, SI is 2-bit driving pulse selecting and specifying data that represents a driving pulse PCOM to be selected from among the above-described driving pulses PCOM, and SP is 16-bit selection switch control data that is used for controlling the On/Off state of a selection switch, to be described later, in accordance with the timing of the selected driving pulse PCOM.

Figure 5:
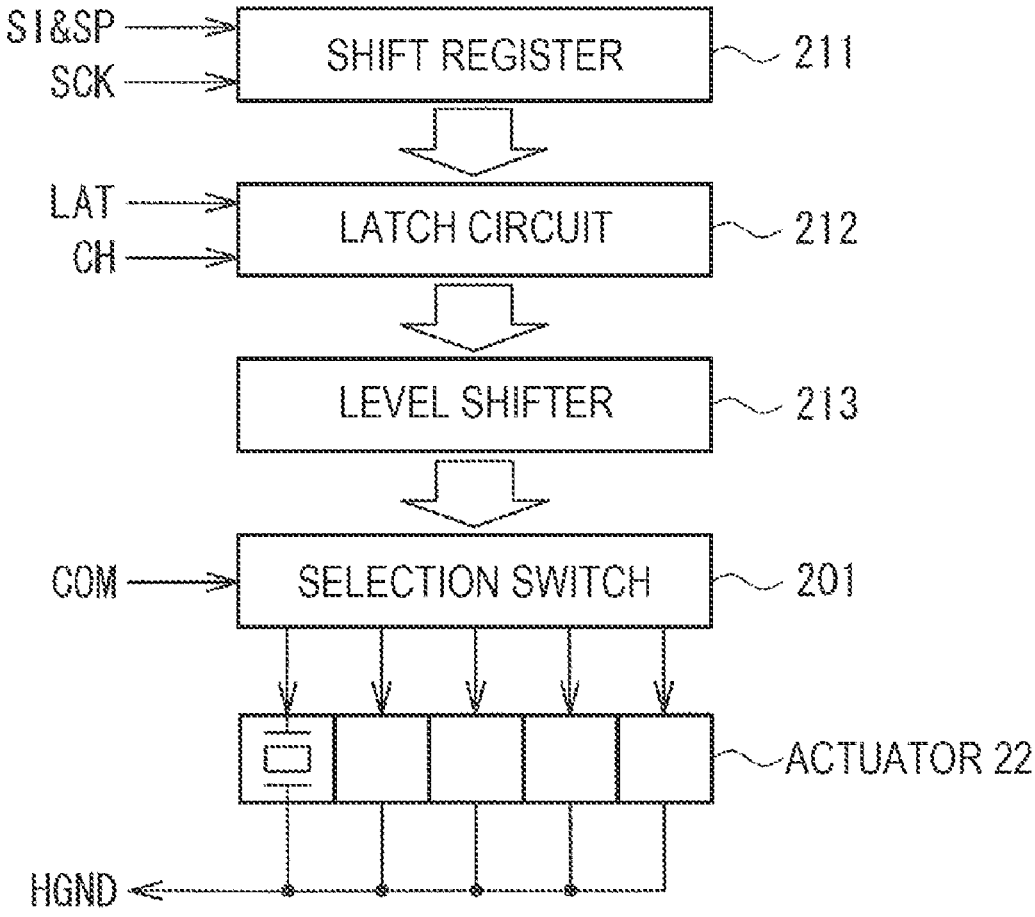
FIG. 5 is a block diagram of a switching controller.

FIG. 5 represents a concrete configuration of a switching controller that is built inside the liquid ejecting head 2 so as to supply the drive signal COM (driving pulse PCOM) to the actuator 22. This switching controller is configured to include: a shift register 211 that stores the driving pulse selecting data SI&SP for designating the actuator 22 such as a piezoelectric device corresponding to a nozzle that ejects liquid; a latch circuit 212 that temporarily stores the data of the shift register 211; and a level shifter 213 that connects the drive signal COM to the actuator 22 such as a piezoelectric device by shifting the level of the output of the latch circuit 212 and supplying the level-shifted output to the selection switch 201.

To the shift register 211, the driving pulse selecting data SI&SP is sequentially input, and the memory area is sequentially shifted from the initial stage to a later stage in accordance with an input pulse of the clock signal SCK. After the driving pulse selecting data SI&SP corresponding to several nozzles is stored in the shift register 211, the latch circuit 212 latches each output signal of the shift register 211 in accordance with the input latch signal LAT. The signal stored in the latch circuit 212 is converted into a voltage level that can be used for turning the selection switch 201 of the next stage on or off by the level shifter 213. The reason for this is that the drive signal COM has a voltage that is higher than the output voltage of the latch circuit 212, and accordingly, the range of operating voltages of the selection switch 201 is set to be high. Accordingly, the actuator 22 such as a piezoelectric device for which the selection switch 201 is closed by the level shifter 213 is connected to the drive signal COM (driving pulse PCOM) at the connecting timing of the driving pulse selecting data SI&SP. In addition, after the driving pulse selecting data SI&SP of the shift register 211 is stored in the latch circuit 212, the data stored in the latch circuit 212 is sequentially updated in accordance with the liquid ejecting timing by inputting the next print information to the shift register 211. In addition, a reference sign HGND shown in the figure is a ground terminal of the actuator 22 such as a piezoelectric device. Even after the actuator 22 such as a piezoelectric device is separated from the drive signal COM (driving pulse PCOM) by the selection switch 201, the input voltage of the actuator 22 is maintained at a voltage value that is a voltage value immediately prior to the separation.

Figure 6:
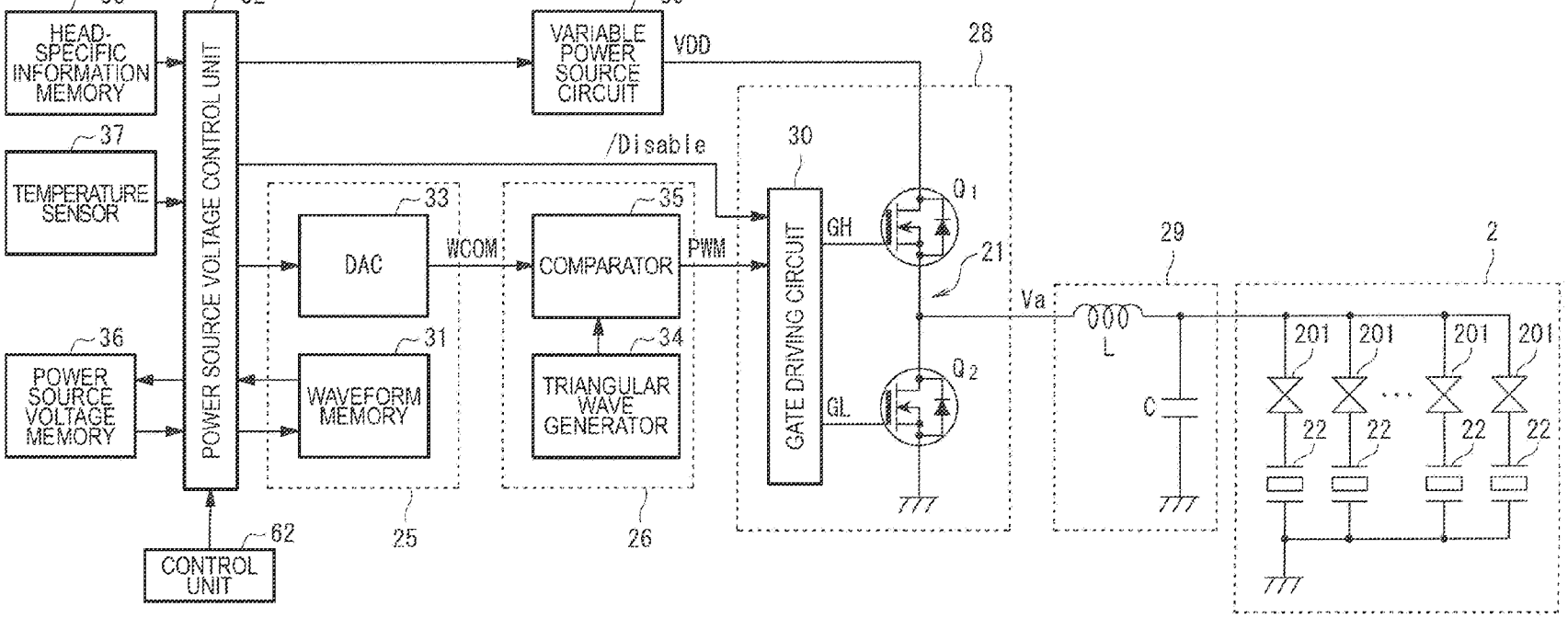
FIG. 6 is a block diagram of a driving circuit of an actuator.

FIG. 6 represents a driving circuit of the actuator 22. This actuator driving circuit is built inside the control unit 62 disposed in the control circuit and the head driver 65. The driving circuit of the first embodiment is configured to include: a drive waveform signal generating circuit 25 that generates the base of the drive signal COM (driving pulse PCOM), that is, a drive waveform signal WCOM that becomes a reference for a signal used for controlling the driving of the actuator 22 based on driving waveform data DWCOM that is stored in advance; a Modulator 26 that performs pulse modulation for the drive waveform signal WCOM generated by the drive waveform signal generating circuit 25; a digital power amplifier 28 that amplifies the power of the modulated signal that has been pulse-modulated by the Modulator 26; and a low pass filter 29 that smoothes the power-amplified of which the power has been amplified by the digital power amplifier 28 and supplies the smoothed amplified digital signal to the liquid ejecting head 2 as a drive signal COM (driving pulse PCOM). This drive signal COM (driving pulse PCOM) is supplied from the selection switch 201 to the actuator 22.

This actuator driving circuit includes a power source voltage control unit 32 that controls the overall operation of the driving circuit and controls the power source voltage. This power source voltage control unit 32 converts the waveform data read from a waveform memory, to be described later, into a voltage signal and performs a calculation process such as a holding operation for a predetermined number of sampling periods, a correction operation for the waveform data, a control operation for the power source voltage that is performed by using a variable power source circuit, or an output operation of an operation stop signal to the gate driving circuit. Accordingly, the power source voltage control unit 32 may be built in the control unit 62.

The drive waveform signal generating circuit 25 is configured to include: the waveform memory 31 that stores the waveform data of a drive waveform signal that is configured by digital voltage data and the like; and a D/A converter (in the figure, DAC) 33 that converts a voltage signal corresponding to the waveform data output from the power source voltage control unit 32 into an analog signal and outputs the analog signal as the drive waveform signal WCOM. Here, when the operation stop signal /Disable is in the low level, the operation of the digital power amplifier 28 is assumed to be stopped.

As the Modulator 26, a known Pulse Width Modulation (PWM) circuit is used. Accordingly, the Modulator 26 compares the drive waveform signal WCOM output from the D/A converter 33 and a triangular wave signal output from a triangular wave generator 34 that outputs a triangular wave signal to each other and outputs a modulated signal having the pulse duty that becomes the on-duty when the drive waveform signal WCOM is larger than the triangular wave signal. In addition, as the Modulator 26, another known pulse Modulator such as a pulse density modulation (PDM) circuit can be used.

The digital power amplifier 28 is configured to include: a half bridge output stage 21 that is configured by a high-side switching device Q1 and a low-side switching device Q2 that are used for substantially amplifying the power; and a gate driving circuit 30 that is used for adjusting gate-to-source signals GH and GL of the high-side switching device Q1 and the low-side switching device Q2 based on the modulated signal output from the Modulator 26. In the digital power amplifier 28, when the modulated signal is in the high level, the gate-to-source signal GH of the high-side switching device Q1 reaches the high level, and the gate-to-source signal GL of the low-side switching device Q2 reaches the low level. Accordingly, the high-side switching device Q1 is in the ON state, and the low-side switching device Q2 is in the OFF state. As a result, the output voltage Va of the half bridge output stage 21 is the power source voltage VDD. On the other hand, when the modulated signal is in the low level, the gate-to-source signal GH of the high-side switching device Q1 reaches the low level, and the gate-to-source signal GL of the low-side switching device Q2 reaches the high level. Accordingly, the high-side switching device Q1 is in the OFF state, and the low-side switching device Q2 is in the ON state. As a result, the output voltage Va of the half bridge output stage 21 is zero.

When the high-side switching device Q1 and the low-side switching device Q2 are digitally driven as described above, a current flows through an ON-state switching device. However, the value of resistance of the drain-to-source is extremely low, and the loss is scarcely generated. In addition, since a current does not flow through an OFF-state switching device, a loss is not generated. Accordingly, the loss of the digital power amplifier 28 is extremely low, and a switching device such as a small MOSFET can be used.

When the operation stop signal /Disable output from the power source voltage control unit 32 is in the low level, as represented in a truth table of the following Table 1, the gate driving circuit 30 turns off both the high-side switching device Q1 and the low-side switching device Q2. As described above, when the digital power amplifier 28 operates, any one of the high-side switching device Q1 and the low-side switching device Q2 is in the ON state. Allowing both the high-side switching device Q1 and the low-side switching device Q2 to be in the OFF state is synonymous to stopping the operation of the digital power amplifier 28, and the actuator 22 formed from a piezoelectric device that is an electrically capacitive load is maintained at the high-impedance state. When the actuator 22 is maintained at the high-impedance state, electric charge accumulated in the actuator 22 that is a capacitive load is maintained. Accordingly, the charging/discharging state is maintained, and minimal self-discharge is suppressed.

TABLE 1

| Pulse Modulated signal | /Disable | 01 | 02 | POWER AMPLIFIER CIRCUIT |
|---|---|---|---|---|
| 0 | 1 | OFF | ON | OPERATION |
| 1 | | ON | OFF | |
| 0 | 0 | OFF | | STOP OPERATION |
| 1 | | | | |

In addition, both the high-side switching device Q1 and the low-side switching device Q2 of the digital power amplifier 28 cannot be in the OFF state only by not outputting the modulated signal PWM (it maintains the low level). The reason for this is as follows. When the modulated signal PWM is in the low level, the gate-to-source signal GH of the high-side switching device Q1 is in the low level, but the gate-to-source signal GL of the low-side switching device Q2 is in the high level. Accordingly, the high-side switching device Q1 is in the OFF state, and the low-side switching device Q2 is in the ON state. Therefore, when the operation stop signal /Disable is in the low level, the gate driving circuit 30 allows both the gate-to-source signal GH of the high-side switching device Q1 and the gate-to-source signal GL of the low-side switching device Q2 to be in the low level.

As the low pass filter 29, a second-order filter that is formed from one capacitor C and one coil L is used. By using this low pass filter 29, the modulation frequency generated by the Modulator 26, that is, a pulse-modulation frequency component is attenuated so as to be eliminated, and accordingly, the drive signal COM (the driving pulse PCOM) having the above-described waveform characteristics is output. In addition, the actuator driving circuit additionally includes: a variable power source circuit 39 that adjusts the power source voltage VDD supplied to the digital power amplifier 28; a power source voltage memory 36 that stores the power source voltage value VDD corresponding to the driving pulse PCOM; a temperature sensor 37 that detects the temperature; and a head-specific information memory 38 that stores correction information that is specific to the liquid ejecting head. In FIG. 6, for convenience of the description, all the components are represented as being formed as circuits. However, the drive waveform signal generating circuit 25 and the Modulator 26 may be built by programming that is performed in the control unit 62 shown in FIG. 3. In addition, the low pass filter 29 may be configured by using stray inductance and stray capacitance that are generated by circuit wirings, the actuator, or the like and does not necessarily need to be formed as a circuit. In addition, the waveform memory 31 may be formed inside the ROM 62*d*.

Figure 7:
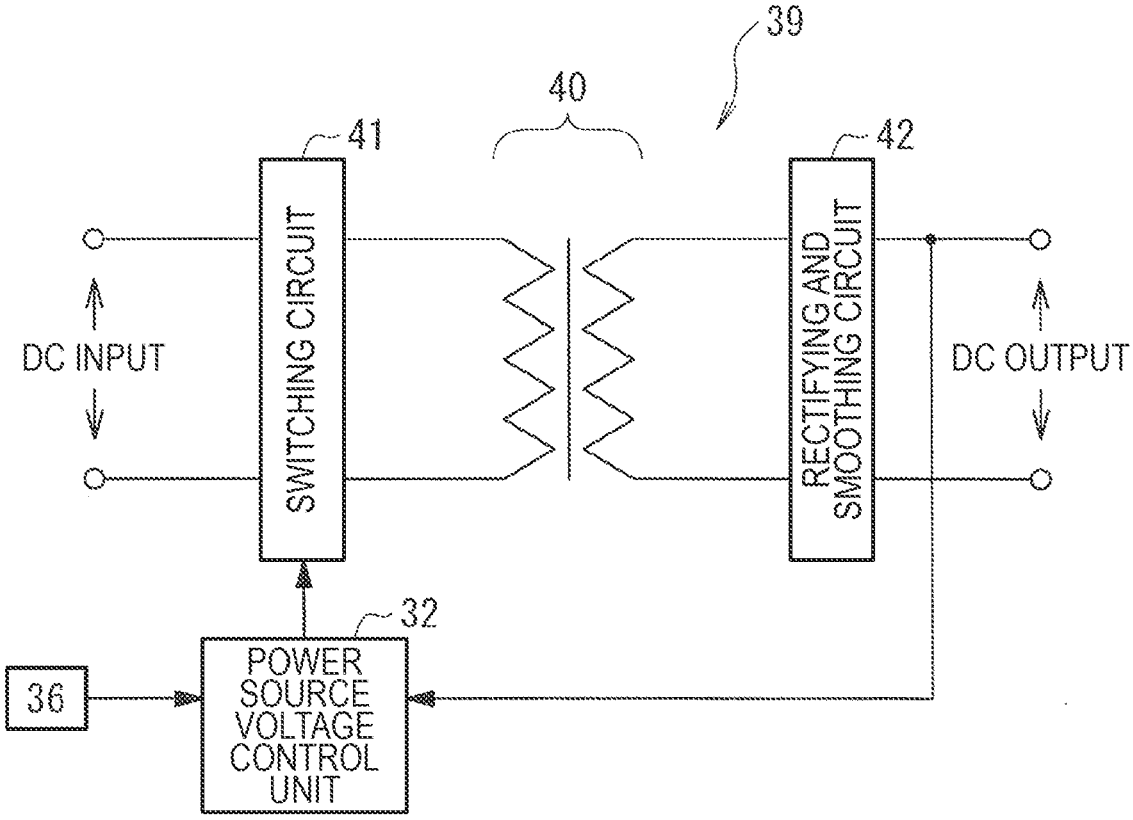
FIG. 7 is a block diagram of a variable power source circuit shown in FIG. 6.

FIG. 7 represents the configuration of the variable power source circuit 39. This variable power source circuit 39 is a known DC-DC converter. By controlling the On/Off state of the switching device of the switching circuit 41 that is disposed on the primary side of a transformer 40 at the frequency corresponding to the power source voltage VDD (Vn) that is directed from the power source voltage control unit 32, the secondary-side voltage of the transformer 40 is rectified and smoothed by a rectifying and smoothing circuit 42. As a result, a desired DC output voltage, in this case, the power source voltage VDD (Vn) of the digital power amplifier 28 can be acquired.

Figure 8:
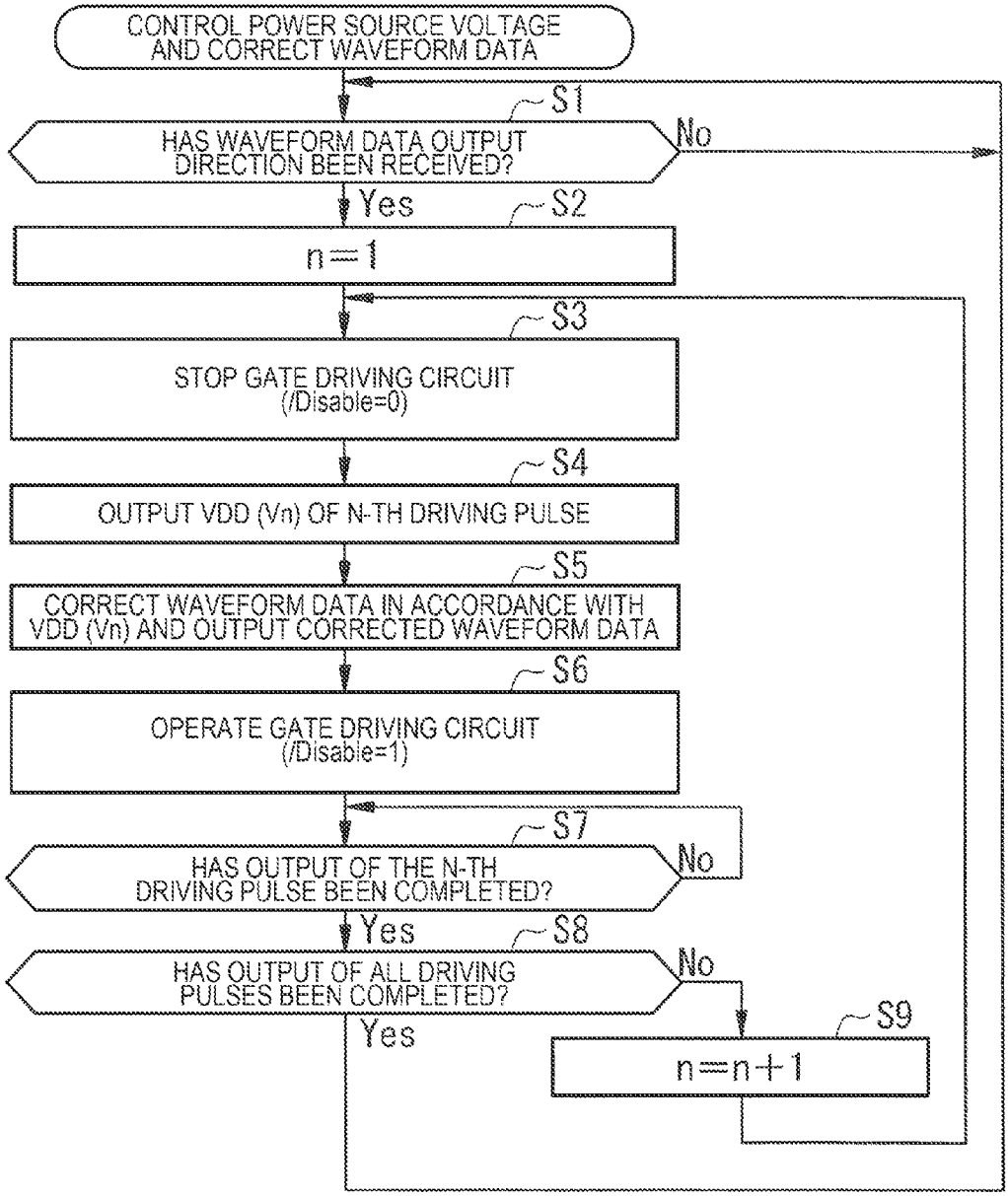
FIG. 8 is a flowchart of a calculation process performed in a power source voltage control unit shown in FIG. 6.

FIG. 8 is a flowchart representing a calculation process for controlling the power source voltage and correcting the waveform data according to the first embodiment that is performed inside the power source voltage control unit 32. This calculation process is performed each time a waveform data output direction is received from the control unit 62. First, in Step S1, it is determined whether or not a waveform data output direction is received from the control unit 62. When the waveform data output direction has been received, the process proceeds to Step S2. Otherwise, the process is in the waiting state. In Step S2, the driving pulse counter n is set to one.

Next, the process proceeds to Step S3, and by allowing the operation stop signal /Disable to be in the low level, the gate driving circuit 30 of the digital power amplifier 28 is stopped. Next, the process proceeds to Step S4, the power source voltage VDD(Vn) of the n-th driving pulse PCOMn (n=1 to 4) is read out from the power source voltage memory 36, and the read power source voltage is output to the switching circuit 41 of the variable power source circuit 39.

Next, the process proceeds to Step S5, the waveform data DWCOM is corrected in accordance with the power source voltage VDD(Vn) of the n-th driving pulse PCOMn that has been read out in Step S4, and the corrected waveform data is output to the D/A converter 33. A method of correcting the waveform data DWCOM will be described later. Next, the process proceeds to Step S6, by allowing the operation stop signal /Disable to be in the high level, the gate driving circuit 30 of the digital power amplifier 28 is operated.

Next, the process proceeds to Step S7, and it is determined whether or not the output of the n-th driving pulse PCOMn has been completed. When the output of the n-th driving pulse PCOMn has been completed, the process proceeds to Step S8. Otherwise, the process is in the waiting state. In Step S8, it is determined whether or not the output of all the driving pulses PCOM has been completed. When the output of all the driving pulses PCOM has been completed, the process proceeds to Step S1. Otherwise, the process proceeds to Step S9. In Step S9, the driving pulse counter n is incremented, and the process proceeds to Step S3.

Next, the method of correcting the waveform data DWCOM that is performed in Step S5 of the calculation process shown in FIG. 8 will be described. Inside the waveform memory 31, data for which a target voltage is output from the low pass filter 29 in a case where the power source voltage VDD is the standard power source voltage VDDref is stored. In other words, when the power source voltage VDD is changed, the data needs to be corrected. In order to perform correction, it may be configured that the n-th waveform data DWCOMn of the n-th driving pulse PCOMn is multiplied by the standard power source voltage VDDref, and the result is divided by the power source voltage VDD(Vn).

Figure 9:
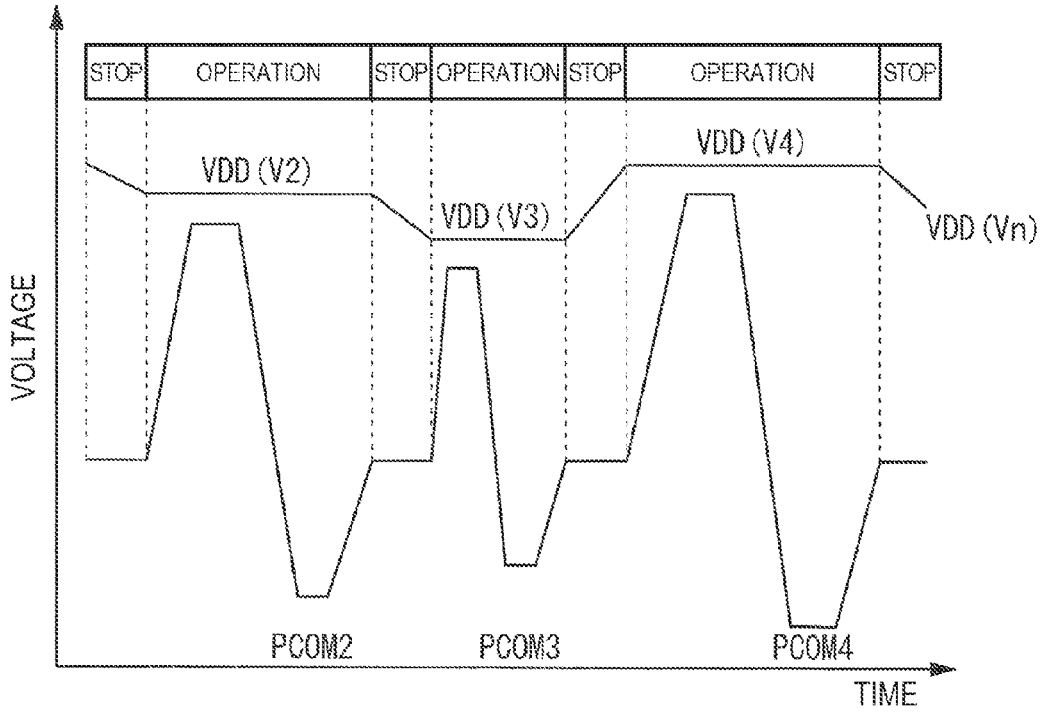
FIG. 9 is a diagram of the waveform of a drive signal according to the calculation process shown in FIG. 8.

According to the calculation process shown in FIG. 8, as shown in FIG. 9, the power source voltage VDD(Vn) is controlled to be changed for each driving pulse PCOMn. The crest value of the driving pulse PCOMn is different for each driving pulse PCOMn. Accordingly, it is preferable that the power source voltage VDD(Vn) has a voltage value for which the maximum voltage of the n-th driving pulse PCOMn can be attained at the maximum usable duty ratio of the modulated signal PWM. By using such a voltage value as the power source voltage VDD(Vn) of the digital power amplifier 28, the efficiency of the apparatus is improved.

In addition, as described above, when the power source voltage VDD(Vn) is changed, the voltage value of the drive signal COM changes. However, the change in the power source voltage VDD(Vn) may be performed in the connection portion of the driving pulse PCOMn. In such a configuration, the change in the voltage of the driving pulse PCOMn can be avoided. In addition, it may be configured that the operation of the digital power amplifier 28 is stopped before changing the power source voltage VDD(Vn), and the operation of the digital power amplifier 28 is resumed after changing the power source voltage VDD(Vn). In such a configuration, while the operation of the digital power amplifier 28 is stopped, the change in the voltage of the driving pulse PCOMn can be avoided. In addition, by turning off both the high-side switching device Q1 and the low-side switching device Q2 of the digital power amplifier 28 together, the operation of the digital power amplifier 28 may be stopped. In such a configuration, the digital power amplifier 28 can be set to the high-impedance state, and accordingly, the charging/discharging of the actuator 22 that is a capacitive load can be suppressed. In addition, by turning off the selection switches 201 of all the actuators 22, the charging/discharging of the actuator 22 that is a capacitive load can be suppressed.

As described above, in the liquid ejecting apparatus of the first embodiment, when the drive waveform signal WCOM is pulse-modulated by the Modulator 26, the power of the modulated signal PWM is amplified by the digital power amplifier 28, and the amplified digital signal is smoothed by the low pass filter 29 so as to be used as the drive signal COM (driving pulse PCOM) of the actuator 22, the power source voltage VDD supplied to the digital power amplifier 28 by the variable power source circuit 39 may be controlled to be changed by the power source voltage control unit 32 for each driving pulse PCOM. In such a configuration, the digital power amplifier 28 can be driven with the optimal power source voltage VDD according to the voltage amplitude of the driving pulse PCOM, and accordingly, the efficiency is improved. In addition, by stopping the operation of the digital power amplifier 28 before the power source voltage VDD for the digital power amplifier 28 is changed by the variable power source circuit 39 and resuming the operation of the digital power amplifier 28 after the power source voltage VDD is changed, the change in the voltage of the drive signal COM (the driving pulse PCOM) during the change in the power source voltage VDD can be avoided.

In addition, when the operation of the digital power amplifier 28 is stopped by turning off both the switching devices Q1 and Q2 of the digital power amplifier 28, both the switching devices Q1 and Q2 of the digital power amplifier 28 can be allowed to be in the high-impedance state. Accordingly, the charging/discharging of the actuator 22 that is a capacitive load can be suppressed. In addition, in a case where the drive signal COM is configured by connecting the driving pulses PCOM in a time series, when the power source voltage VDD supplied to the digital power amplifier 28 by the variable power source circuit 39 is changed by the connection portion of the driving pulse PCOM, change in the voltage of the driving pulse PCOM used for driving the actuator 22 can be avoided.

Next, a liquid ejecting apparatus according to a second embodiment of the invention will be described. The liquid ejecting apparatus of this embodiment, similarly to the first embodiment, is applied to a liquid ejecting printing apparatus. Accordingly, the schematic configuration, the vicinity of the liquid ejecting head, the control device, the drive signal, the switching controller, the actuator driving circuit, and the variable power source circuit are the same as those of the first embodiment. Thus, in the description presented below, the same reference numeral is assigned to the same configuration as that of the first embodiment, and the description thereof is omitted. In the second embodiment, the calculation process performed by the power source voltage control unit 32 is different from that of the first embodiment.

There is a tradeoff in setting the power source voltage value. For example, when the minimum voltage and the maximum voltage of the driving pulse PCOM are 5 V and 48 V, and the minimum duty ratio and the maximum duty ratio of the output of the digital power amplifier 28 are 10% and 90%, in order to output the minimum voltage of the driving pulse PCOM, the power source voltage VDD needs to be set to be equal to or lower than 50 V. On the other hand, in order to output the maximum voltage of the driving pulse PCOM, the power source voltage VDD needs to be set to be equal to or higher than 53.5 V. Here, the minimum duty ratio and the maximum duty ratio of the output of the digital power amplifier 28 are determined based on the minimum pulse width and the maximum pulse width of the output of the digital power amplifier 28. Accordingly, when the modulation frequency of the pulse modulation is decreased, the width of the minimum duty ratio and the maximum duty ratio of the output can be increased. In such a case, the precision of the driving pulse PCOM is decreased, and accordingly, precise liquid ejection control cannot be performed. However, according to the second embodiment, precise liquid ejection control can be performed.

Figure 10:
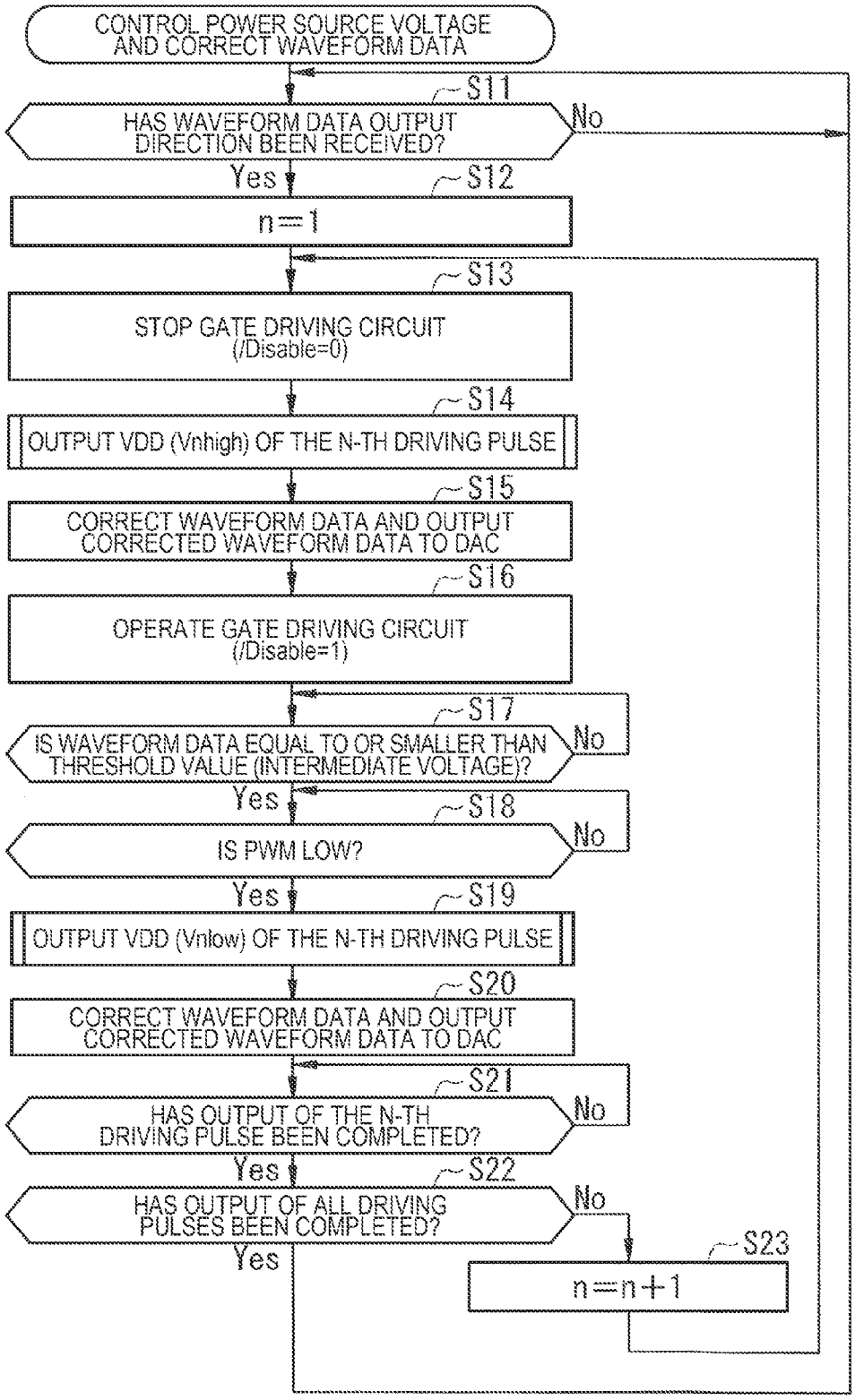
FIG. 10 is a flowchart of a calculation process for power source voltage control that is performed by a liquid ejecting printing apparatus using a liquid ejecting apparatus according to an embodiment of the invention.

FIG. 10 is a flowchart representing a calculation process for controlling the power source voltage and correcting the waveform data according to the second embodiment that is performed inside the power source voltage control unit 32. This calculation process is performed each time when a waveform data output direction is received from the control unit 62. First, in Step S11, it is determined whether or not a waveform data output direction is received from the control unit 62. When the waveform data output direction has been received, the process proceeds to Step S12. Otherwise, the process is in the waiting state. In Step S12, the driving pulse counter n is set to one.

Next, the process proceeds to Step S13, and by allowing the operation stop signal /Disable to be in the low level, the gate driving circuit 30 of the digital power amplifier 28 is stopped. Next, the process proceeds to Step S14, the power source voltage VDD(Vnhigh) of the n-th driving pulse PCOMn (n=1 to 4) corresponding to a high voltage portion is set in accordance with the calculation process represented in FIGS. 12A and 12B, to be described later, and the power source voltage corresponding to the high voltage portion is output to the switching circuit 41 of the variable power source circuit 39.

Next, the process proceeds to Step S15, the waveform data DWCOM is corrected in accordance with the power source voltage VDD(Vnhigh) of the n-th driving pulse PCOMn corresponding to the high voltage portion that has been set in Step S14, and the corrected waveform data is output to the D/A converter 33. The method of correcting the waveform data DWCOM is the same as described above. Next, the process proceeds to Step S16, by allowing the operation stop signal/Disable to be in the high level, the gate driving circuit 30 of the digital power amplifier 28 is operated.

Next, the process proceeds to Step S17, and it is determined whether or not the read waveform data DWCOM is equal to or smaller than a threshold value, that is, equal or smaller than an intermediate voltage in this case. When the read waveform data DWCOM is equal to or smaller than the intermediate voltage, the process proceeds to Step S18. Otherwise, the process is in the waiting state. In Step S18, it is determined whether or not the modulated signal PWM is in the low level. When the modulated signal PWM is in the low level, the process proceeds to Step S19. Otherwise, the process is in the waiting state. In Step S19, in accordance with the calculation process represented in FIG. 11, to be described later, the power source voltage VDD(Vnlow) of the n-th driving pulse PCOMn (n=1 to 4) corresponding to a low voltage portion is set and the power source voltage corresponding to the low voltage portion is output to the switching circuit 41 of the variable power source circuit 39.

Next, the process proceeds to Step S20, the waveform data DWCOM is corrected in accordance with the power source voltage VDD (Vnlow) of the n-th driving pulse PCOMn corresponding to the low voltage portion that is set in Step S19, and the corrected waveform data is output to the D/A converter 33. The method of correcting the waveform data DWCOM is the same as described above. Next, the process proceeds to Step S21, and it is determined whether or not the output of the n-th driving pulse PCOMn has been completed. When the output of the n-th driving pulse PCOMn has been completed, the process proceeds to Step S22. Otherwise, the process is in the waiting state. In Step S22, it is determined whether or not the output of all the driving pulses PCOM has been completed. When the output of all the driving pulses PCOM has been completed, the process proceeds to Step S11. Otherwise, the process proceeds to Step S23. In Step S23, after the driving pulse counter n is incremented, the process proceeds to Step S13.

Figure 11:
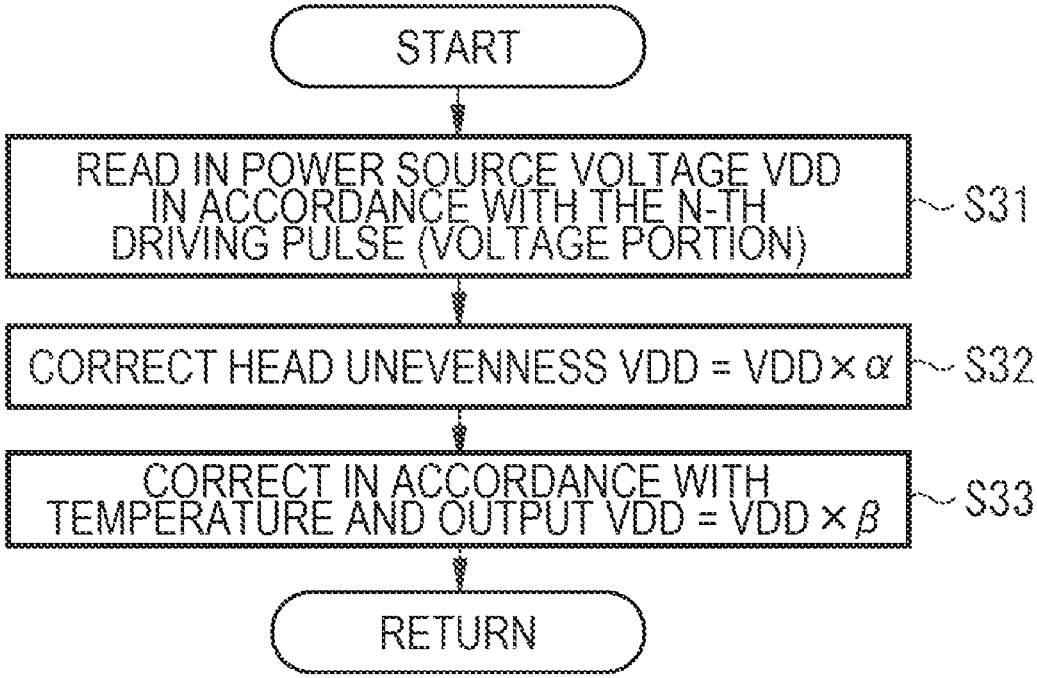
FIG. 11 is a flowchart of subroutines performed in the calculation process shown in FIG. 10.

Next, the calculation process of subroutines performed in Step S14 and Step S19 of the calculation process represented in FIG. 10 will be described with reference to the flowchart represented in FIG. 11. In this calculation process, first, in Step S31, the power source voltage VDD(Vnhigh) of the n-th driving pulse PCOMn (n=1 to 4) corresponding to the high voltage portion or the power source voltage VDD(Vnlow) (in the figure, the power source voltage VDD) of the n-th driving pulse corresponding to the low voltage portion is read out from the power source voltage memory 36.

Next, the process proceeds to Step S32, and a correction value α corresponding to the individual variation (in the figure, unevenness) of the liquid ejecting head 2 is read out with reference to a table, for example, as shown in FIG. 12A that is stored in the head-specific information memory 38. Then, the correction value α is multiplied by the power source voltage VDD(Vnhigh) of the n-th driving pulse PCOMn (n=1 to 4) corresponding to the high voltage portion or the power source voltage VDD(Vnlow) (in the figure, the power source voltage VDD) of the n-th driving pulse corresponding to the low voltage portion that has been read in Step S31, and the resultant value is set as a new power source voltage VDD(Vnhigh) of the n-th driving pulse PCOMn (n=1 to 4) corresponding to the high voltage portion or a new power source voltage VDD (Vnlow) (in the figure, the power source voltage VDD) of the n-th driving pulse corresponding to the low voltage portion.

Next, the process proceeds to Step S33, and a correction value β corresponding to the temperature is read out with reference to a table, for example, as shown in FIG. 12B based on the temperature information detected by the temperature sensor 37. Then, the correction value β is multiplied by the power source voltage VDD(Vnhigh) of the n-th driving pulse PCOMn (n=1 to 4) corresponding to the high voltage portion or the power source voltage VDD(Vnlow) (in the figure, the power source voltage VDD) of the n-th driving pulse corresponding to the low voltage portion that has been calculated in Step S32, and the resultant value is set as a new power source voltage VDD(Vnhigh) of the n-th driving pulse PCOMn (n=1 to 4) corresponding to the high voltage portion or a new power source voltage VDD(Vnlow) (in the figure, the power source voltage VDD) of the n-th driving pulse corresponding to the low voltage portion, and then the process returns to the calculation process shown in FIG. 10. According to such a calculation process, the maximum value and the minimum value of the driving pulse PCOM can be output without decreasing the PWM frequency. Therefore, precise liquid ejection control can be performed.

Figure 13:
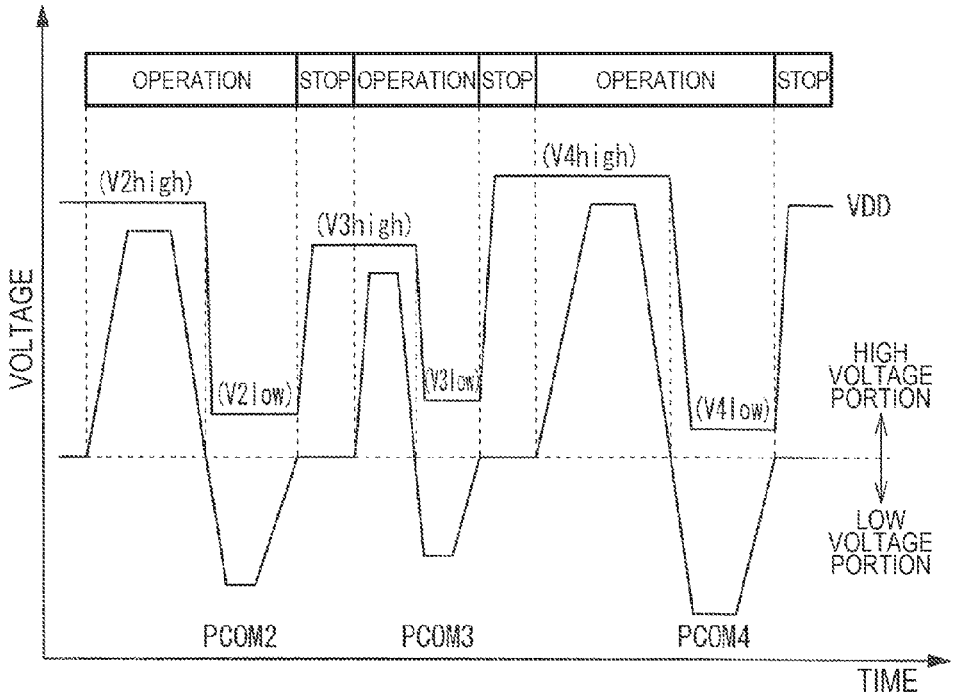
FIG. 13 is a diagram showing the waveform of a drive signal according to the calculation process shown in FIG. 10.

In addition, similarly to the first embodiment, as shown in FIG. 13, the power source voltage VDD(Vnhigh) corresponding to the high voltage portion is controlled to be changed for each driving pulse PCOMn. The power source voltage VDD (Vnhigh) corresponding to the high voltage portion can be preferably used as a voltage value for which the maximum voltage of the corresponding n-th driving pulse PCOMn can be attained with the maximum usable duty ratio of the modulated signal PWM. Accordingly, by setting such a voltage value to the power source voltage VDD(Vnhigh) corresponding to the high voltage portion of the digital power amplifier 28, the efficiency of the apparatus is improved.

In addition, similarly to the first embodiment, when the change in the power source voltage VDD(Vnhigh) corresponding to the high voltage portion is performed in the connection portion of the driving pulse PCOMn, the change in the voltage of the driving pulse PCOMn can be avoided. In addition, when the operation of the digital power amplifier is stopped before changing the power source voltage VDD(Vnhigh) corresponding to the high voltage portion, and the operation of the digital power amplifier 28 is resumed after changing the power source voltage VDD(Vnhigh) corresponding to the high voltage portion, the change in the voltage of the driving pulse PCOMn can be avoided while the operation of the digital power amplifier 28 is stopped. In addition, when the operation of the digital power amplifier 28 is stopped by turning off both the high-side switching device Q1 and the low-side switching device Q2 of the digital power amplifier 28 together, the digital power amplifier 28 can be set to the high-impedance state, and accordingly, the charging/discharging of the actuator 22 that is a capacitive load can be suppressed. In addition, as described above, by turning off the selection switches 201 of all the actuators 22, the charging/discharging of the actuator 22 that is a capacitive load can be suppressed.

In addition, in the second embodiment, within one driving pulse PCOMn, the high voltage portion and the low voltage portion may be changed to the power source voltage VDD (Vnhigh) corresponding to the high voltage portion and the power source voltage VDD(Vnlow) corresponding to the low voltage portion. In such a configuration, the power source voltage supplied to the digital power amplifier 28 can be controlled to be changed more finely, and accordingly, the efficiency can be improved. In addition, in the second embodiment, the threshold value of the high voltage portion and the low voltage portion within one driving pulse PCOMn is set to the intermediate voltage of which the voltage value does not change, and accordingly, the change in the voltage of the driving pulse PCOMn can be suppressed or prevented.

Figure 14A:
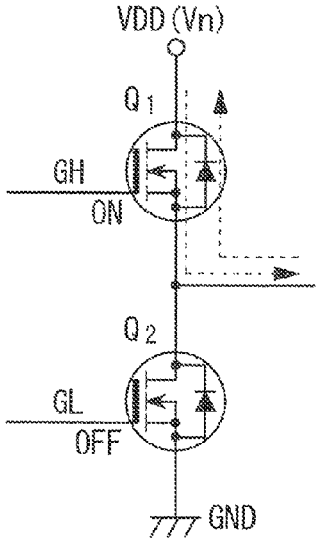
FIGS. 14A and 14B are schematic diagrams illustrating actions according to the calculation process shown in FIG. 10.
Figure 14B:
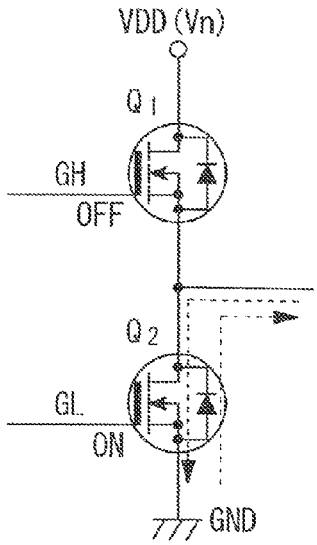

In addition, in the second embodiment, the change from the power source voltage VDD(Vnhigh) corresponding to the high voltage portion to the power source voltage VDD(Vnlow) corresponding to the low voltage portion may be performed when the modulation single PWM is in the low level. In such a configuration, the change in the voltage of the driving pulse PCOMn can be avoided. In other words, as shown in FIG. 14A, during a period (the modulated signal PWM is in the high level) during which the high-side switching device Q1 is turned on, a current flows in from the power source voltage VDD(Vn), or a current flows back to the power source voltage VDD(Vn) through a bodydiode of the high-side switching device Q1. Thus, when the power source voltage VDD(Vn) is changed in such a state, there is a change in the output voltage, that is, the voltage of the driving pulse PCOMn. On the other hand, as shown in FIG. 14B, during a period (the modulated signal PWM is in the low level) during which the low-side switching device Q2 is turned on, a current flows in the ground GND, or a current flows back from the ground GND through a bodydiode of the low-side switching device Q2. Accordingly, even when the power source voltage VDD(Vn) is changed in such a state, there is no change in the output voltage, that is, the voltage of the driving pulse PCOMn.

In addition, the power source voltage VDD(Vn) supplied to the digital power amplifier 28 may be changed in accordance with the individual variation of the liquid ejecting head 2. In such a configuration, the voltage of the driving pulse PCOMn can be controlled with high precision. In addition, the power source voltage VDD(Vn) supplied to the digital power amplifier 28 may be changed in accordance with the temperature. In such a configuration, the voltage of the driving pulse PCOMn can be controlled with high precision.

As described above, according to the liquid ejecting apparatus of the second embodiment, in addition to the advantages of the first embodiment, by changing the power source voltage VDD(Vn) supplied to the digital power amplifier 28 by the variable power source circuit 39 in the high voltage portion and the low voltage portion within one driving pulse PCOMn, the power source voltage VDD(Vn) supplied to the digital power amplifier 28 can be controlled to be changed more finely. Accordingly, the efficiency can be improved. In addition, the threshold value of the high voltage portion and the low voltage portion within one driving pulse PCOMn is set to the intermediate voltage of which the voltage value does not change, and accordingly, the change in the voltage of the driving pulse PCOMn can be suppressed or prevented.

In addition, the power source voltage VDD(Vn) supplied to the digital power amplifier 28 by the variable power source circuit 39 is changed when the modulated signal PWM is in the low level. Accordingly, the output voltage of the digital power amplifier 28 is not influenced by the change in the power source voltage VDD(Vn). Therefore, the change in the voltage of the driving pulse PCOMn can be avoided. In addition, the power source voltage VDD(Vn) supplied to the digital power amplifier 28 by the variable power source circuit 39 is changed in accordance with the individual variation of the liquid ejecting head (apparatus) 2. Accordingly, the voltage of the driving pulse PCOMn can be controlled with high precision.

In addition, by changing the power source voltage VDD (Vn) supplied to the digital power amplifier 28 by the variable power source circuit 39 in accordance with the temperature, the voltage of the driving pulse PCOMn can be controlled with high precision. In the first and second embodiments, only a case where the liquid ejecting device according to an embodiment of the invention is used in a line head-type ejecting printing apparatus has been described in detail. However, the liquid ejecting apparatus according to an embodiment of the invention can be similarly applied to a multiple-path liquid ejecting printing apparatus.

In addition, the liquid ejecting apparatus according to an embodiment of the invention can be implemented in a liquid ejecting apparatus that ejects a liquid (including, other than a liquid, a liquid-phase body in which particles of functional materials are dispersed or a fluid-phase body, such as a gel) other than ink or a fluid (solid that can be ejected as a flowing fluid body) other than liquid. For example, the liquid ejecting apparatus may be a liquid-phase ejecting apparatus that ejects a liquid-phase body containing a material such as an electrode material or a coloring material that is used for manufacturing a liquid crystal display, an EL (electroluminescence) display, an field emission display, a color filter, or the like in a dispersed form or a solution form, a liquid ejecting apparatus that ejects a liquid containing a bioorganic material that is used for manufacturing a bio chip, or a test material ejecting apparatus used as a precision pipette. Furthermore, the liquid ejecting apparatus may be a liquid ejecting apparatus that ejects a lubricant to a precision machine such as a clock or a camera in a pin-point manner, a liquid ejecting apparatus that ejects a transparent resin solution such as an ultraviolet-curable resin onto a substrate for forming a tiny hemispherical lens (optical lens) used in an optical communication element or the like, or a liquid ejecting apparatus that ejects an acid etching solution, an alkali etching solution, or the like, for etching a substrate, or the like, a fluid-phase ejecting apparatus that ejects a gel, or a fluid ejecting printing apparatus that ejects a solid, for example, powders such as a toner. An embodiment of the invention can be applied to any one of the above-described ejecting apparatuses.

This application claims priority to Japanese Patent Application No. 2009-249187, filed on Oct. 29, 2009, the entirety of which is hereby incorporated by reference.

What is claimed is:

1. A liquid ejecting apparatus comprising:

a Modulator that performs pulse modulation for a drive waveform signal that becomes a reference for a drive signal of an actuator so as to acquire a modulated signal;

a digital power amplifier that amplifies the power of the modulated signal so as to acquire a amplified digital signal;

a low pass filter that smoothes the amplified digital signal so as to acquire the drive signal;

a variable power source circuit that can change a power source voltage of the digital power amplifier; and a power source voltage control unit that controls changes in the power source voltage in units of a driving pulse that configures the drive signal of the actuator and can independently drive the actuator.

2. The liquid ejecting apparatus according to claim 1, wherein the power source voltage control unit stops an operation of the digital power amplifier before the change in the power source voltage and operates the digital power amplifier after the change in the power source voltage.

3. The liquid ejecting apparatus according to claim 2, wherein the digital power amplifier includes a switching device, and wherein the power source voltage control unit stops the operation of the digital power amplifier by turning off the switching device of the digital power amplifier.

4. The liquid ejecting apparatus according to claim 1, wherein the drive signal is configured by connecting the driving pulses in a time series, and wherein the power source voltage control unit changes the power source voltage in a connection portion of the driving pulse.

5. The liquid ejecting apparatus according to claim 1, wherein the power source voltage control unit changes the power source voltage to a high voltage portion and a low voltage portion that configure one driving pulse.

6. The liquid ejecting apparatus according to claim 5, wherein a threshold value of the high voltage portion and the low voltage portion is set to an intermediate voltage having a voltage value that does not change.

7. The liquid ejecting apparatus according to claim 1, wherein the power source voltage control unit changes the power source voltage of the digital power amplifier that is supplied by the variable power source circuit when the modulated signal is in the low level.

8. The liquid ejecting apparatus according to claim 1, wherein the power source voltage control unit changes the power source voltage in accordance with individual variations of the liquid ejecting apparatus.

9. The liquid ejecting apparatus according to claim 1, wherein the power source voltage control unit changes the power source voltage of the digital power amplifier that is supplied by the variable power source circuit in accordance with the temperature.

10. A liquid ejecting printing apparatus comprising the liquid ejecting apparatus according to claim 1.

* * * * *